US007913605B2

(12) United States Patent
Mercier

(10) Patent No.: US 7,913,605 B2
(45) Date of Patent: Mar. 29, 2011

(54) MISSILE LAUNCHER

(75) Inventor: Jean Claude Mercier, Morsang sur Orge (FR)

(73) Assignee: MBDA France, Paris (FR)

( * ) Notice: Subject to any disclaimer, the term of this patent is extended or adjusted under 35 U.S.C. 154(b) by 0 days.

(21) Appl. No.: 11/631,763

(22) PCT Filed: Jul. 11, 2005

(86) PCT No.: PCT/FR2005/050569
§ 371 (c)(1),
(2), (4) Date: Jan. 28, 2008

(87) PCT Pub. No.: WO2006/016084
PCT Pub. Date: Feb. 16, 2006

(65) Prior Publication Data

US 2008/0282875 A1 Nov. 20, 2008

(30) Foreign Application Priority Data

Jul. 13, 2004 (FR) ..... 04 51516

(51) Int. Cl.
*F41F 3/04* (2006.01)

(52) U.S. Cl. ..... 89/1.819

(58) Field of Classification Search ..... 89/1.8, 89/1.809, 1.81, 1.816, 1.819
See application file for complete search history.

(56) References Cited

U.S. PATENT DOCUMENTS

| | | | | |
|---|---|---|---|---|
| 3,228,294 | A * | 1/1966 | Hickman | 89/1.8 |
| 4,934,241 | A * | 6/1990 | Piesik | 89/1.817 |
| 5,837,917 | A * | 11/1998 | Macnab et al. | 89/1.8 |
| 5,847,307 | A | 12/1998 | Kennedy et al. | 89/1.817 |
| 5,942,713 | A * | 8/1999 | Basak | 89/1.816 |
| 6,079,310 | A * | 6/2000 | Yagla et al. | 89/1.816 |
| 6,283,005 | B1 * | 9/2001 | Yagla et al. | 89/1.816 |

FOREIGN PATENT DOCUMENTS

| | | |
|---|---|---|
| EP | 0473498 A1 | 3/1992 |
| EP | 0933611 A2 | 8/1999 |
| EP | 1225411 A2 | 7/2002 |

OTHER PUBLICATIONS

International Search Report, PCT/FR2005/050569, 2 pgs., (Dec. 12, 2005).

* cited by examiner

*Primary Examiner* — Bret Hayes
(74) *Attorney, Agent, or Firm* — Nixon Peabody LLP

(57) ABSTRACT

This missile launcher is characterized in that the cells do not extend in rows parallel to an elongated chimney, but by surrounding a central chimney, providing a more compact and especially lighter arrangement with identical resistance conditions.

12 Claims, 5 Drawing Sheets

MISSILE LAUNCHER

CROSS REFERENCE TO RELATED APPLICATIONS OR PRIORITY CLAIM

This application is a national phase of International Application No. PCT/FR2005/050569 entitled "Missile Launcher", which was filed on Jul. 11, 2005, which was not published in English, and which claims priority of the French Patent Application No. 04 51516 filed Jul. 13, 2004.

TECHNICAL FIELD

The subject of this invention is a missile launcher.

Such a machine comprises a structure delimiting cells for housing individual missiles, also called ammunition in the art, at least one chimney for gas flow and a plenum chamber, the cells and the chimney opening at an end face of the launcher (generally the upper face) and the plenum chamber extending to an opposite end of the launcher; the cells and the chimney open into the plenum chamber through apertures of a base plate forming the ceiling of the chamber. Further, swinging doors close the cells and the chimney when the launcher is at rest and are pulled aside when the missiles must be fired. The combustion gases produced in the cells are ejected into the plenum chamber and discharged from the launcher through the chimney. Their large pressure exerts consequent forces on the plenum chamber, the chimney and the whole structure of the launcher. The designer should generously dimension the launcher and face constraints on the acceptable weight limit, at least when the launcher is to be integrated into a marine vessel.

BACKGROUND

In a known design, two parallel rows of four cells each are positioned on either side of a chimney with a rectangular section extending over the whole length of the rows. The large length of the size of the chimney imposes a thick chimney duct in order to withstand the significant flexure produced by the pressure of the gases, and therefore the significant weight.

A design derived from the previous one is shown in EP 0 473 498 A. The single chimney is divided into four chimneys with circular section, each of which faces a cell of each of both rows. In other words, each small chimney resulting from the division is placed between two cells. The chimneys are of a circular shape and therefore better withstand the internal pressure of the gases. However, as this solution remains a heavy solution, it is proposed that chimneys be built in composite material in order to reduce their weight, but it is doubtful that a significant gain in weight may be achieved since these chimneys can no longer be thermally assembled to the remainder of the structure and should therefore themselves withstand the forces to which they are subject.

SUMMARY

The invention relates to a missile launcher which enhances the oldest design in a different way from what is discussed in the aforementioned patent.

Unlike the prior designs where the cells were positioned in rows along the chimney, here they extend around it, in the form of a circle or regular polygon. A not insignificant reduction of the size of the launcher may be obtained with this arrangement of the cells, and especially a significant gain in mass correlated with a greater strength of the structure, notably when it is integrated into a marine vessel such as a surface ship, for reasons which will be given in the following of this description.

An excellent realization consists of arranging eight cells in a square at the angles and at the middles of the sides, and the chimney occupying the centre thereof.

BRIEF DESCRIPTION OF THE DRAWINGS

The invention will now be described in connection with the figures.

DETAILED DESCRIPTION

Figure 1:
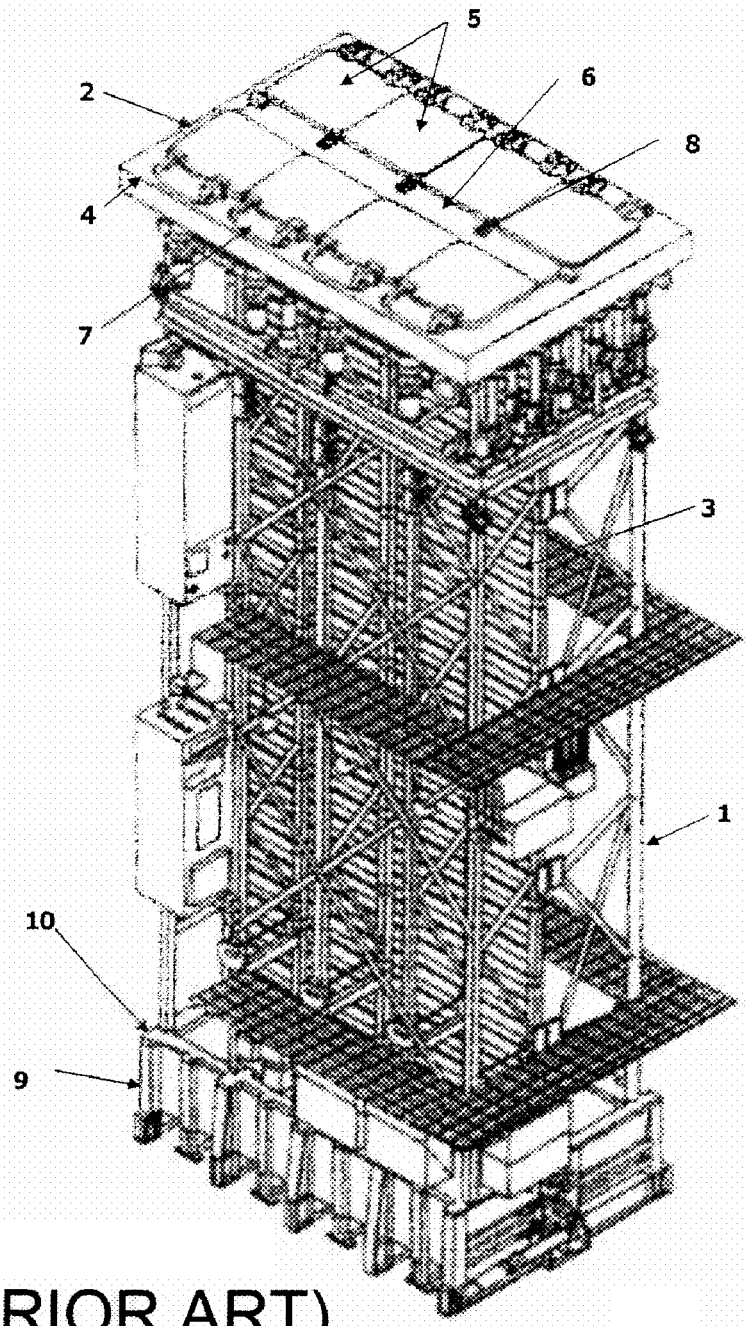
FIG. 1 (PRIOR ART)
FIG. 1 is an overview of the structure of the launcher.
Figure 2:
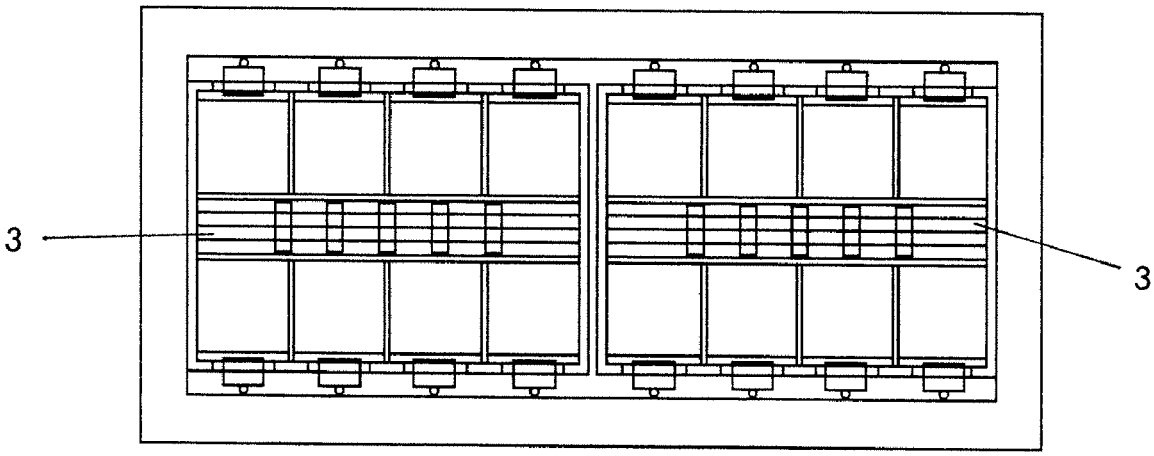
FIG. 2 (PRIOR ART)
FIGS. 2 and 3 are two comparative views of an arrangement with two launchers.

FIG. 1 illustrates a launcher of the prior art, including certain details also again found in the invention. This is the oldest design. A structure 1 of plates and intersecting plates is used as a framework for the launcher and delimits eight cells 2 distributed in 2 parallel rows of four and a chimney 3 intermediate to the rows. The cells 2 and the chimney 3 are delimited by square tubular ducts which do not appear on the figure, for the cells 2 and rectangular ones for the chimney 3. The cells 2 and the chimney 3 open on the outside at one end of the launcher located on the top, through an upper plate 4 which may correspond to a deck of a surface marine vessel. Doors 5 and 6 close the cells 2 and the chimney 3 at rest and clear them by opening around hinges 7 and 8. The launcher further comprises a lower plenum chamber 9, the ceiling of which is formed by a base plate 10 to which the remainder of the structure 1 is connected and which is provided with apertures at the location of the cells 2 and of the chimney 3 to provide passage for the combustion gases from those cells into the latter. FIG. 2 shows a possible arrangement of both of these launchers on a same support giving the possibility of firing up to sixteen missiles: the launchers are placed side by side with the chimneys 3 in alignment by their main extension direction, a small gap separating them.

Figure 3:
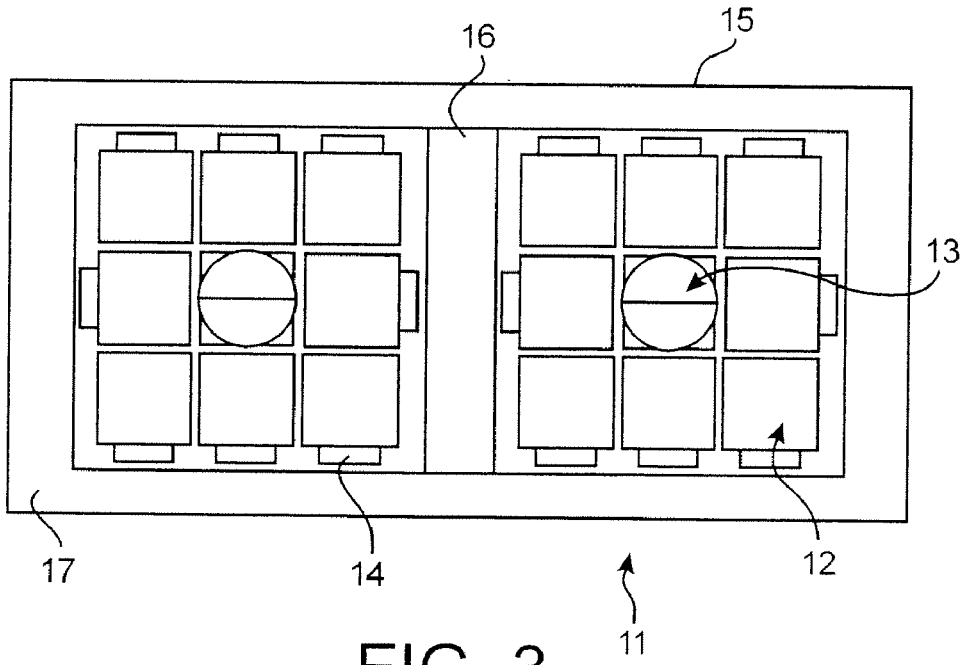

A comparative diagram of the invention is illustrated in FIG. 3. The same number of sixteen cells is used for the same number of two launchers 11. Here, the launchers 11 have a square shape and the cells 12 are placed at its periphery, three on each side, or also four at the angles of the square, and four between two neighboring angles. A single chimney 13 placed in the centre of the square is again found between the four cells 12 at the middle of the sides. Unlike the prior design, the chimney 13 is not elongated but circular.

A comparison with the arrangement of FIG. 2 shows that for an identical cell section, the launcher 11 is more compact that the launcher derived from the prior design by means of the smallest section of the chimney 13. This benefit of space is not completely utilized with a construction with several launchers 11 since they are spaced out more apart from each other than in the prior designs. Actually it is required that the doors of the cells 12 located towards the outside, open by swinging around hinges 14 on the periphery, and therefore towards the other launcher 11 for cells 12 located in opposition. The doors of the chimneys 13 consist of two semicircular halves joined by a line and opening by moving away from each other again by a swinging movement.

Sufficient separation of the launchers 11 should therefore be maintained in order to avoid impacts between the doors. This drawback of saving less space as one might have expected is however compensated by structural reinforcement of the vessel and therefore by a significantly larger gain in weight.

Figure 4:
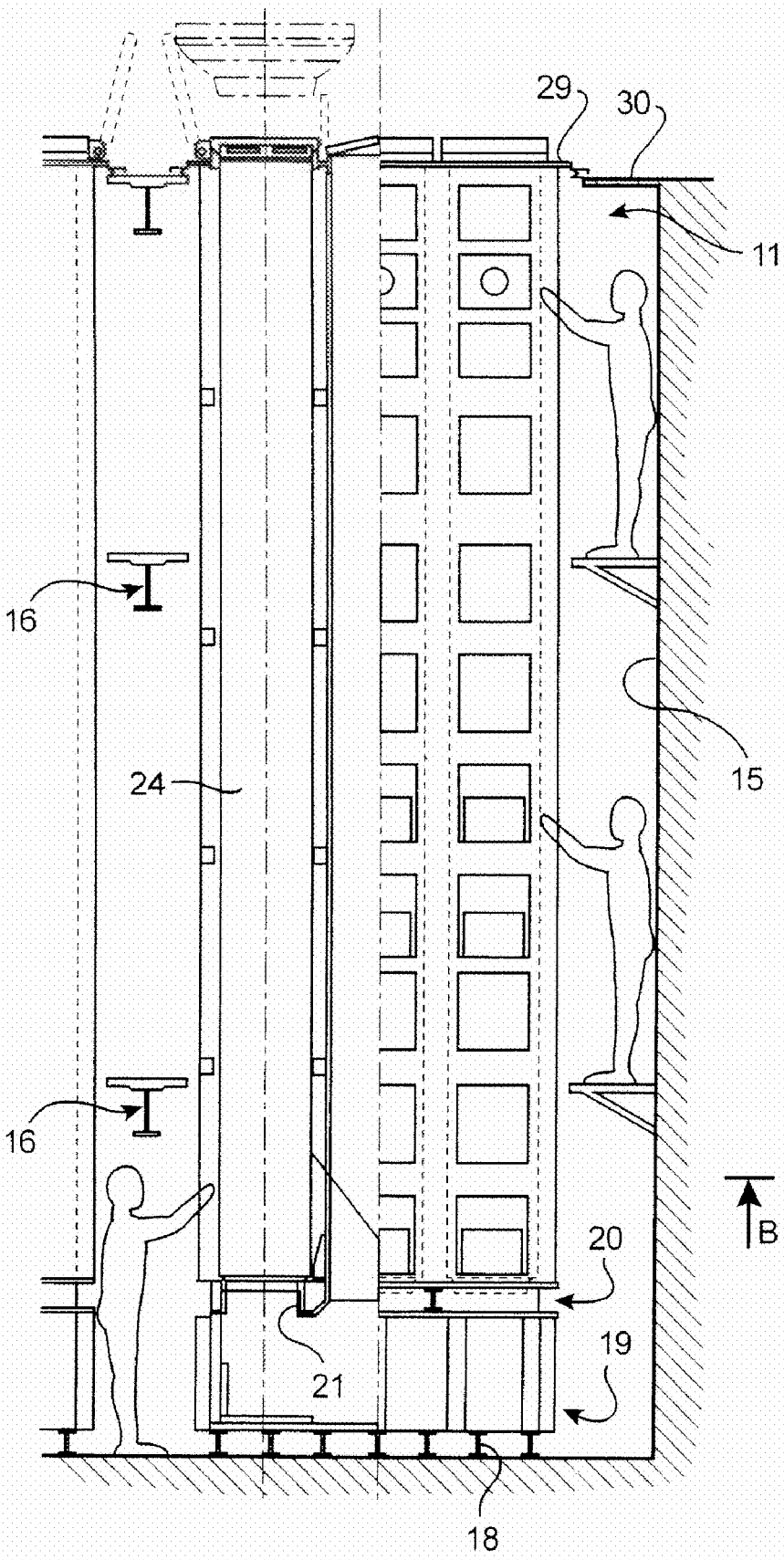
FIG. 4 is a vertical sectional view of the launcher.

When the launchers according to the invention or to another design are placed in a vessel, a well 15 should be provided for receiving them. The structure of the vessel is considerably weakened by it. By using the invention, it is however possible to limit this drawback by positioning reinforcement girders 16 between two launchers 11 as this is also seen in FIG. 4. The large sides of the well 15, which are therefore subject to more significant deformations, are then stiffened and may be built in a much more lightweight manner. The space of the well 15 which is not occupied by the launchers 11 and which comprises a space at their periphery and between them, is a passageway 17 for maintenance personnel to access the cells 12.

FIG. 4 and the following figures illustrate the structure of a launcher 11. A layer of I-beams 18 supports the plenum chamber 19 of the launcher 11, which is in the shape of a flat box with a square section and which is strongly stiffened depending on the pressures which it should withstand. Its lateral sides are formed with two plates provided with intermediate stiffeners. Its ceiling is formed by a base plate 20 also consisting of two superimposed plates and connected by stiffeners, other I-girders here. Apertures 21 are placed through the base plate 20 under each cell 12 and under the chimney 13. The structure of the remainder of the launcher is substantially in a form of a cage and it comprises sixteen uprights 22 regularly positioned in four rows to the corners of the cells 12. They support guide rails 23, also vertical, for square missile ducts 24 which delimit cells 12, and they are joined by horizontal and intersecting crossbars 25 around the launcher 11 within it.

Figure 5:
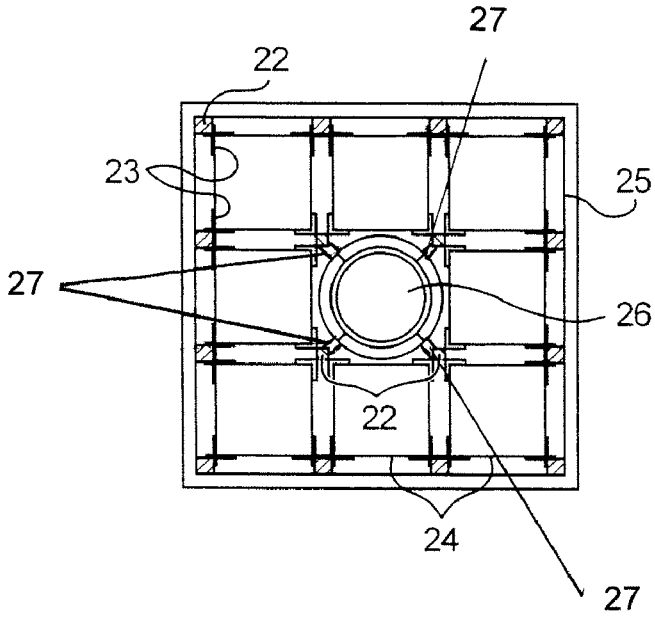
FIG. 5 is a horizontal sectional view of the launcher.
Figure 8:
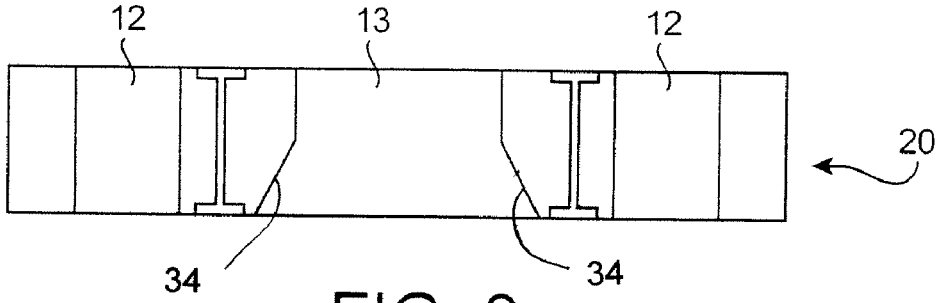
FIG. 8 is a view of the base plate surmounting the plenum chamber.

The chimney 13 is also visible in FIG. 5. It is formed by a circular duct 26, the diameter of which is slightly larger than the dimension of the ducts of the missiles 24. Contrary to what was the case with the rectangular chimney, the chimney duct 26 may extend very close to the ducts of missiles 24 as it remains at a distance from the closest uprights 22 thanks to its circular shape. Evacuation of the gases is facilitated by the largest diameter which may be ascribed to it. The presence of a convergent inside the ceiling of the plenum chamber 19 is still possible and it reduces the pressure losses and the pressure of the gases exerted in the chimney 13 and the lower plenum chamber 19. The convergent 34 appears in FIG. 8 and consists of a widening of the chimney 13 downwards into the base plate 20, over at least one portion of its height.

Figure 6:
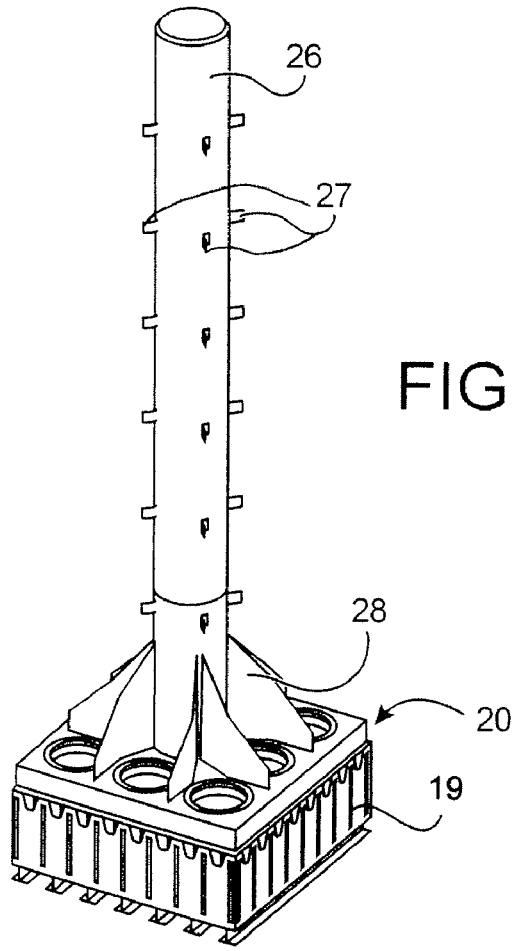
FIG. 6 is an isolated view of the chimney.

It appears in FIG. 6 that the chimney duct 26 may be assembled to uprights 22 passing close to it by welded small plates 27, and at the base plate 20 of the plenum chamber 19 by triangular-shaped ribs 28, two of the sides of which are welded to the duct 26 and to the base plate 20 and which pass between the apertures 21 of the cells 12. To summarize, by using a relatively narrow chimney 13 but with a resistant circular shape, it is possible to use a metal duct 26, the weight of which is not excessive and which may be firmly assembled to the remainder of the launcher's structure by small plates 27 and ribs 28, which improves the strength of the whole.

Figure 7:
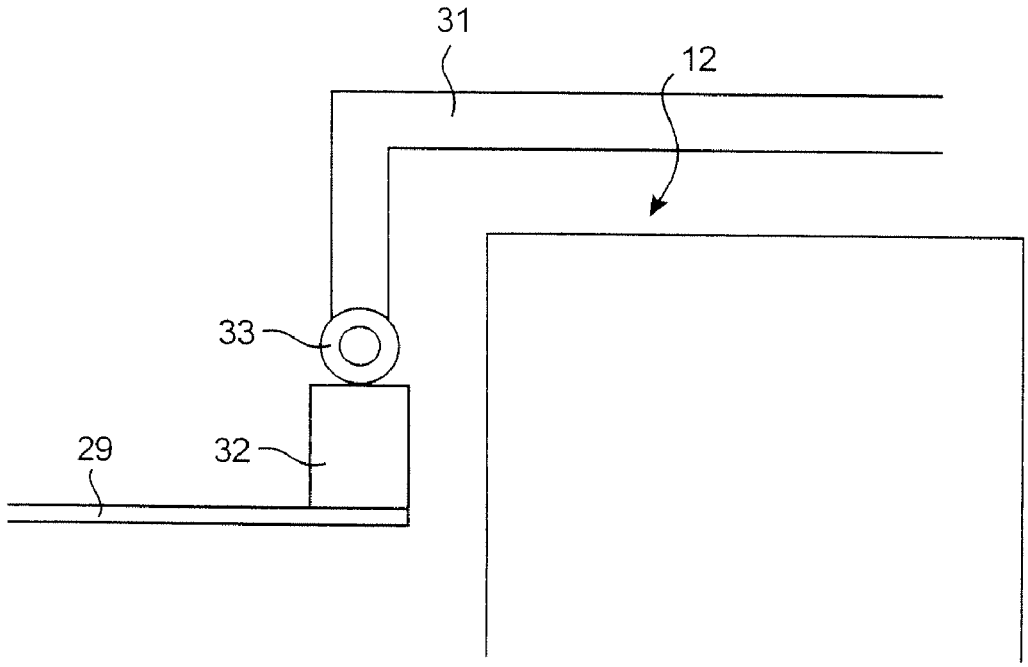
FIG. 7 is a partial view of the top of the launcher.

Another aspect of the invention is to be discovered in FIG. 7. The structure of the launcher 11 is closed at the top by an upper plate 29 which is connected to the deck of the vessel as seen in FIG. 4 via seal gaskets. The doors 31 of the cells 12 should protect them from the environment and especially from big waves. In the traditional design, the edge of the doors is directly supported on the upper plate 29 of the launcher via a gasket, which is of doubtful value. Rather it is recommended to establish a borderline called a pavement 32 on the upper plate 29 around each of the cells 12 and to have the doors 31 rest on them; the doors 31 are provided with a gasket 33 with a closed notably circular section, which is crushed on the pavement 32 and provides a much better seal.

What is claimed is:

1. A missile launcher comprising a structure delimiting cells for housing individual missiles, at least one chimney for gas flow and a plenum chamber, the cells and the chimney opening at an end face of the launcher and the plenum chamber extending at an opposite end face of the launcher, the cells and the chimney opening into the plenum chamber through apertures of a base plate forming a ceiling of the chamber, characterized in that the chimney being unique and positioned at a center of said chamber, wherein the cells are positioned in a circle or a regular polygon around and surrounding the chimney.

2. The missile launcher according to claim 1, characterized in that the cells are eight in number and positioned along a square, wherein a first set of four cells extend at angles of the square and a second set of four cells extend between said angles, the chimney being positioned between the second set of four cells.

3. The missile launcher according to claim 2, characterized in that the chimney is delimited by a metal duct connected to the structure by attachment tabs.

4. The missile launcher according to claim 1, characterized in that the chimney is delimited by a metal duct connected to the structure by attachment tabs.

5. The missile launcher according to claim 4, characterized in that the duct comprises triangular ribs joined to the base plate.

6. The missile launcher according to claim 1, characterized in that swinging doors placed above the cells are provided with gaskets with a closed section pressing against borderlines erected on the end face of the structure.

7. The missile launcher according to claim 1, characterized in that the chimney is connected through a convergent to the plenum chamber.

8. The missile launcher according to claim 1, wherein the chimney is located at a center position.

9. A missile launcher comprising:

a structure configured to house at least one missile in a corresponding cell, the structure including a top end and a bottom end;

a plenum chamber located proximal to the bottom end of the structure;

at least one vertically oriented chimney positioned substantially in a center of the structure, the chimney having a circular cross sectional shape and having a top end and a bottom end, the chimney disposed on the plenum chamber such that the bottom end of the chimney is in communication with the plenum chamber, the chimney having an opening at the top end proximal to the top end of the structure;

a first set of cells within the structure, the first set including a first cell and a second cell on opposing sides of the chimney along a first vertical plane such that the first cell, the second cell and the chimney are coplanar along the first vertical plane;

a second set of cells within the structure, the second set including a third cell and a fourth cell on opposing sides of the chimney along a second vertical plane such that the third cell, the fourth cell and the chimney are coplanar along the second vertical plane, wherein the second vertical plane is substantially perpendicular to the first vertical plane.

10. The missile launcher according to claim 9, further comprising a third set of cells within the structure, the third set including a fifth cell and a sixth cell on opposing sides of the chimney and coplanar with the chimney along a third vertical plane oriented at an angle equidistant between the first and second vertical planes.

11. The missile launcher according to claim 10, further comprising a fourth set of cells within the structure, the fourth set including a seventh cell and an eighth cell on opposing sides of the chimney and coplanar with the chimney along a fourth vertical plane oriented at an angle equidistant between the first and second vertical planes, wherein the fourth vertical plane is substantially perpendicular to the third vertical plane.

12. A missile launcher comprising a structure delimiting cells for housing individual missiles, at least one chimney for gas flow oriented parallel to the cells and a plenum chamber, the cells and the chimney opening at an end face of the launcher and the plenum chamber extending at an opposite end face of the launcher, the cells and the chimney opening into the plenum chamber through apertures of a base plate forming a ceiling of the chamber, characterized in that the chimney being unique and positioned at a center of said chamber, wherein the cells are positioned in a circle or a regular polygon surrounding the chimney.

* * * * *